US008122794B2

(12) United States Patent
Lai

(10) Patent No.: US 8,122,794 B2
(45) Date of Patent: Feb. 28, 2012

(54) TORQUE SOCKET ASSEMBLY

(76) Inventor: Jin-Tsai Lai, Taichung (TW)

( * ) Notice: Subject to any disclaimer, the term of this patent is extended or adjusted under 35 U.S.C. 154(b) by 319 days.

(21) Appl. No.: 12/631,865

(22) Filed: Dec. 7, 2009

(65) Prior Publication Data

US 2011/0132156 A1 Jun. 9, 2011

(51) Int. Cl.
*B25B 23/143* (2006.01)

(52) U.S. Cl. ..... 81/475

(58) Field of Classification Search ..... 81/473–475
See application file for complete search history.

(56) References Cited

U.S. PATENT DOCUMENTS 4,262,501 A * 4/1981 Vaughn et al. ..... 464/36
4,272,973 A * 6/1981 Fu-Tsai ..... 464/23
4,346,633 A * 8/1982 Rendl ..... 81/475
5,094,330 A * 3/1992 Lee ..... 464/39
7,581,471 B2 * 9/2009 Chiu et al. ..... 81/475

* cited by examiner

*Primary Examiner* — David B Thomas

(57) ABSTRACT

A torque socket assembly includes a base which has a receiving hole defined therein. A tube sleeves on the base. The tube has a first portion and a second portion. The first portion has a recess defined in an outer periphery thereof. The first portion partially sleeves on an outer periphery of the base. A torque setting unit includes a first teethed gear disposed in the receiving hole, a second teethed gear meshed with the first teethed gear, a resilient unit abuts against the second teethed gear and the second portion, and a rod passes through the tube. The second teethed gear has an indentation formed on an outer surface thereof. A securing unit includes a pin disposed in the recess. A spring sleeves on the first portion of the tube and contacts with the pin, and an outer sleeve sleeves on outer peripheries of the spring and the tube.

7 Claims, 7 Drawing Sheets

TORQUE SOCKET ASSEMBLY

BACKGROUND OF THE INVENTION

1. Field of the Invention

The present invention relates to a torque socket assembly, and more particularly, to a torque socket assembly with improved structure and providing a stable torque value 2. Description of Related Art A conventional torque socket assembly commonly known in accordance with the prior art comprises a receiving portion, a driving portion, and a middle portion disposed in between the receiving portion and the driving portion. The receiving portion has a quadrangular hole for adapting to co-operate with a driving tool. The driving portion is a polygon-shaped hole for adapting to receive a fastener (i.e. a bolt). The middle portion has a plurality of embossed patterns and a plurality of smooth faces alternately and annularly formed on the outer periphery thereof. The embossed patterns provide increment to the friction when the socket assembly is grasped by hands, such that a user may selectively adapts the socket assembly to a driving tool or simply grasps the socket assembly by hands for operation.

However, the conventional socket assembly bears several disadvantages. First of all, the conventional socket assembly does not include a torque adjusting unit therefore it is not capable to provide a predetermined torque. When in operation, the user can merely tightened the fastener with an object, and is unable to determine whether the torque applied is sufficient to securely fasten the fastener with the object. In addition, the user is not acknowledged if the torque applied has reached the torque required, which may consequently lead to over-tightening of the fastener, such that the structure of the socket assembly is easily damaged due to over-tightening. Nevertheless, high precision in a torque applied is often required when applying a socket assembly to fasten a fastener with the object; even minor errors in the torque applied may lead to unexpected result. Due to the lack of the torque adjusting unit of the conventional socket assembly, when a stable torque is required for fastening a series of fasteners, it is difficult for the user to apply a same force continuously, which may easily lead to slight variations in the torque values. Therefore, the conventional socket assembly is inconvenient to use.

The present invention has arisen to obviate/mitigate the disadvantages of the conventional torque socket assembly.

SUMMARY OF THE INVENTION

The main objective of the present invention is to provide a torque socket assembly which has an improved structure and provides a stable torque value.

To achieve the objective, a torque socket assembly in accordance with the present invention comprises a base which has a securing hole laterally defined therein. The base has a connecting portion formed on one end thereof, which is adapted to connect with a driving tool. Another end of the base has a receiving hole defined therein. A securing flange is annularly formed on an outer periphery of the base.

A tube sleeves on the base. The tube has a first portion and a second portion which is connected with the first portion. The first portion has a recess defined in an outer periphery thereof. The recess has a through hole defined in a bottom thereof. Two inclined inner walls are oppositely formed on two sides of the recess. The second portion has a driving hole defined in one end thereof. The first portion partially sleeves on an outer periphery of the base such that the receiving hole communicates with the driving hole of the second portion.

A torque setting unit includes a first teethed gear which is disposed in the receiving hole, a second teethed gear which meshes with the first teethed gear, a resilient unit which abuts against the second teethed gear and a bottom of the second portion, and a rod which axially passes through the resilient unit, the first teethed gear and the second teethed gear. One end of the rod is threadedly secured in the base. Another end of the rod has a driving portion formed thereon which is adapted to receive a driver. The first teethed gear and the second teethed gear are polygon-shaped. The second teethed gear has an indentation formed on an outer surface thereof. A fastener is screwed into the securing hole of the base and is abutted against the rod for confining the rod from rotating relative to the base.

A securing unit includes a pin which is disposed in the recess in the first portion, a spring which sleeves on an outer periphery of the first portion of the tube and contacts with the pin, and an outer sleeve which has an inner shoulder annularly formed on an inner periphery of one end thereof for abutting against the spring. The outer sleeve slidably sleeves on outer peripheries of the spring and the tube, and is abutted against the securing flange of the base, such that the outer sleeve is prevented from overly sleeving on the base.

Accordingly, by securing the rod within the base, the resilient unit is compressed, such that the resilient unit, the first and the second teethed gear provide a stable torque value. When an applying force exceeds the stable torque value provided, the second teethed gear is abutted against the first teethed gear and slidably disengaged from the first teethed gear, such that the indentation of the second teethed gear corresponds to the through hole of the recess, and the pin disposed in the recess falls in the indentation and is abutted against the indentation of the second teethed gear via the through hole for refraining the second teethed gear from engaging with the first teethed gear.

In accordance with another aspect of the present invention, an elastic unit is disposed in the receiving hole. The elastic unit is abutting against a bottom of the receiving hole and the first teethed gear.

Further benefits and advantages of the present invention will become apparent after a careful reading of the detailed description with appropriate reference to the accompanying drawings.

DETAILED DESCRIPTION OF THE INVENTION

Figure 1:
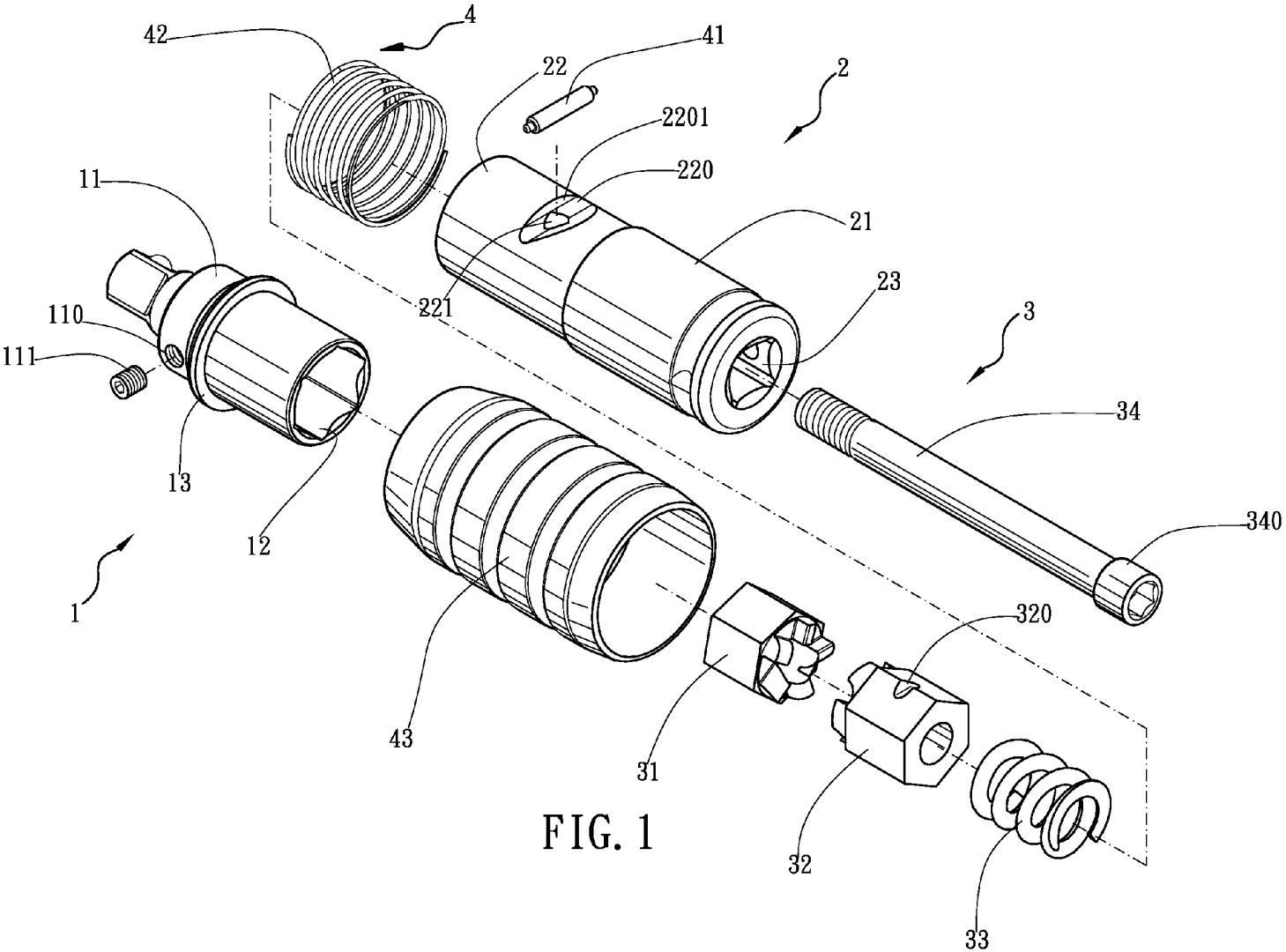
FIG. 1 is an exploded perspective view to show a torque socket assembly in accordance with the present invention.
Figure 2:
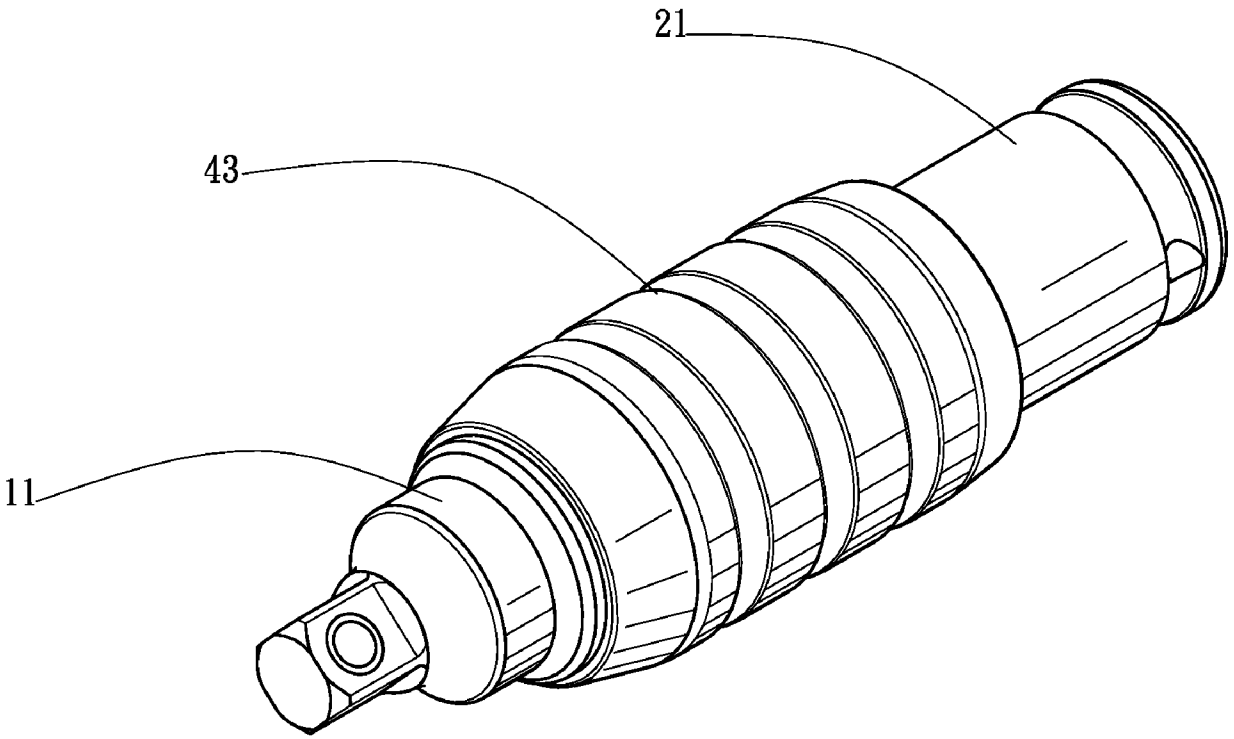
FIG. 2 is an assembled perspective view of the torque socket assembly in accordance with the present invention.

Referring to FIGS. 1-4, a torque socket assembly in accordance with the present invention comprises a base 1 which has a securing hole 110 laterally defined therein. The base 1 has a connecting portion 11 formed on one end thereof. The base 1 is adapted to connect with a driving tool (i.e. a pneumatic hand tool). Another end of the base 1 has a receiving hole 12 defined therein. A securing flange 13 is annularly formed on an outer periphery of the base 1.

A tube 2 sleeves on the base 1. The tube 2 has a first portion 22 and a second portion 21 which is connected with the first portion 22. The first portion 22 has a recess 220 defined in an outer periphery thereof. The recess 220 has a through hole 221 defined in a bottom thereof. Two inclined inner walls 2201 are oppositely formed on two sides of the recess 220. The second portion 21 has a driving hole 23 defined in one end thereof. The first portion 22 partially sleeves on an outer periphery of the base 1 such that the receiving hole 12 communicates with the driving hole 23 of the second portion 21 and the base 1 is rotatable relative to the tube 2.

Figure 3:
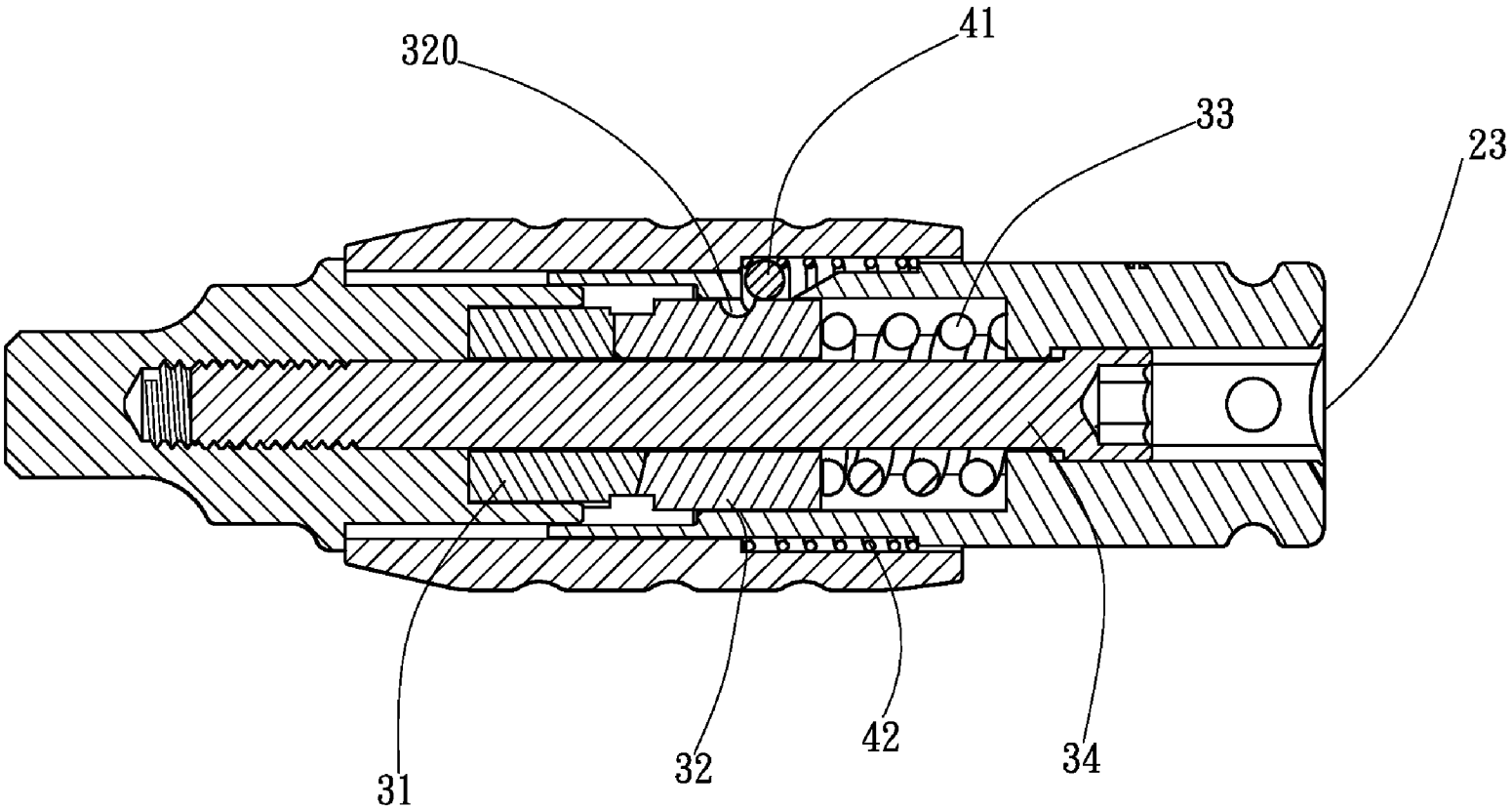
FIG. 3 is a cross sectional view to show a first and a second teethed gear of the torque socket assembly in accordance with the present invention meshed with each other.

A torque setting unit 3 includes a first teethed gear 31 which is disposed in the receiving hole 12, a second teethed gear 32 which meshes with the first teethed gear 31, a resilient unit 33 which abuts against the second teethed gear 32 and a bottom of the second portion 21, and a rod 34 which axially passes through the resilient unit 33, the first teethed gear 31 and the second teethed gear 32. The first teethed gear 31 has a series of first teeth (not numbered) extending upwardly from a top thereof. The second teethed gear 32 has a series of second teeth (not numbered) extending upwardly from a top thereof and correspond to the first teeth (as shown in FIGS. 1 and 3), such that the first teeth and the second teeth meshed with each other. One end of the rod 34 has a threaded portion (not numbered) formed thereon. The threaded portion of the rod 34 is threadedly secured in the base 1. Another end of the rod 34 has a driving portion 340 formed thereon which is adapted to receive a driver (not shown). A fastener 111 is screwed into the securing hole 110 of the base 1 and is abutted against the rod 34 for confining the rod 34 from rotating relative to the base 1. Moreover, the first teethed gear 31 and the second teethed gear 32 are polygon-shaped, such that the first and the second teethed gear 31, 32 are firmly secured. In the present embodiment, the first and the second teethed gear 31 32 are hexagonal (as shown in FIG. 1). The second teethed gear 32 has an indentation 320 formed on an outer surface thereof.

A securing unit 4 includes a pin 41 which is disposed in the recess 220 in the first portion 22, a spring 42 which sleeves on an outer periphery of the first portion 22 of the tube 2 and contacts with the pin 41, and an outer sleeve 43 which has an inner shoulder 431 annularly formed on an inner periphery of one end thereof for abutting against the spring 42. The outer sleeve 43 slidably sleeves on outer peripheries of the spring 42 and the tube 2, and is abutted against the securing flange 13 of the base 1, therefore, the outer sleeve 43 is prevented from overly sleeving on the base 1. The second teethed gear 32 is partially protruded from the through hole 221 of the recess 220 and slightly abuts against the pin 41, such that the pin 41 is slightly detached from the bottom of the recess 220.

Accordingly, by securing the rod 34 within the base 1, the resilient unit 33 is compressed, such that the resilient unit 33, the first and the second teethed gear 31, 32 provide a stable torque value.

Figure 4:
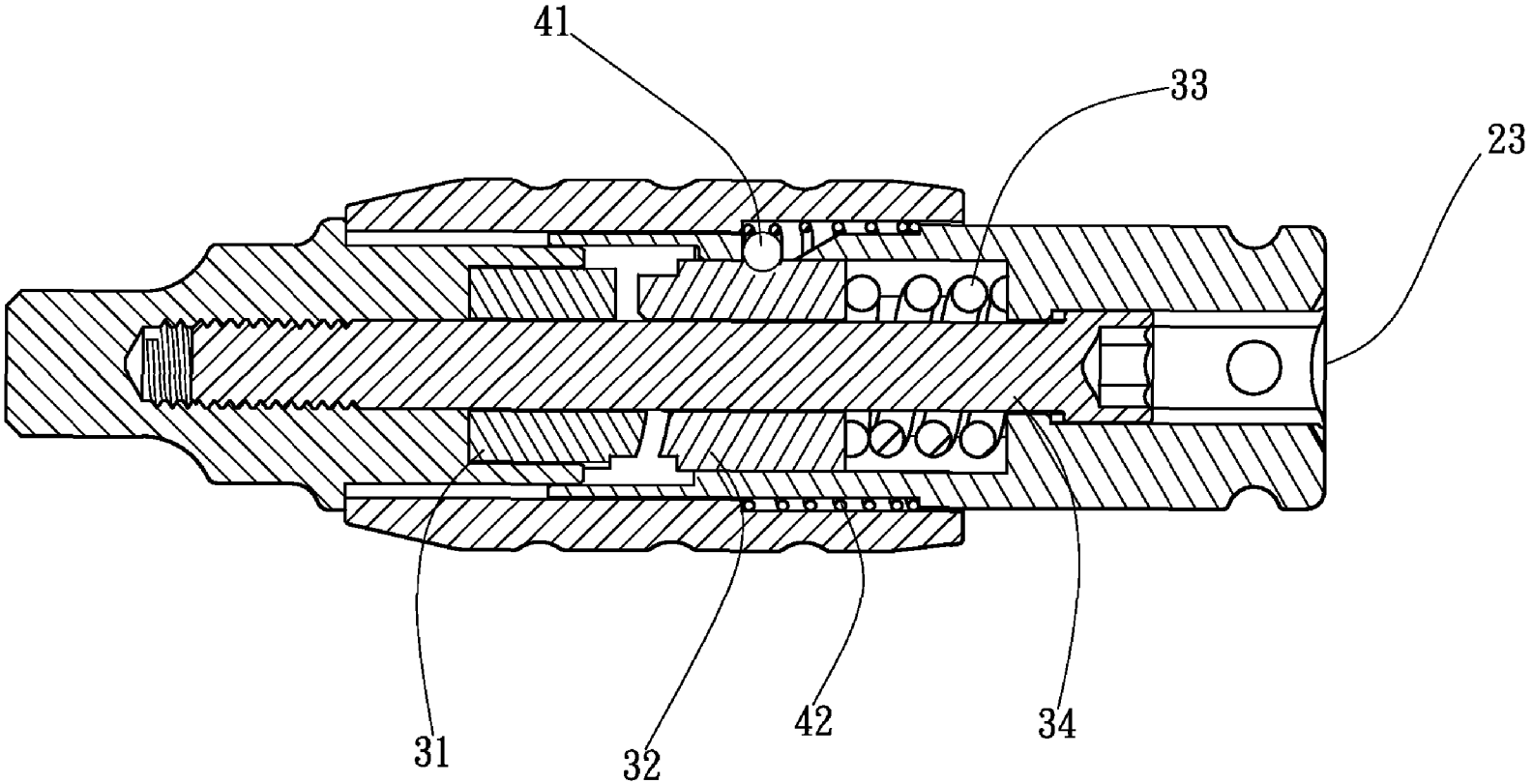
FIG. 4 is a cross sectional view to show a pin disposed in the recess of the first portion of a tube in accordance with the present invention falls into an indentation of the second teethed gear when the second teethed gear is disengaged from the first teethed gear.

As shown in FIG. 4, when an applying force exceeds the stable torque value provided, the second teethed gear 32 abuts against the first teethed gear 31 and slidably disengaged from the first teethed gear 31, such that the indentation 320 of the second teethed gear 32 corresponds to the through hole 221 of the recess 220, and the pin 41 which is disposed in the recess 220 falls in the indentation 320 and is abutted against the indentation 320 of the second teethed gear 32 via the through hole 221 for refraining the second teethed gear 32 from engaging with the first teethed gear 31. Therefore, when the applying force exceeds the stable torque value provided, the first teethed gear 31 idlingly rotates with the base 1 relative to the second teethed gear 32, preventing the first and second teethed gear 31, 32 from wearing due to continuous collision with each other.

When a user slides the outer sleeve 43 toward the driving hole 23, the inner shoulder 431 of the outer sleeve 43 abuts against and compresses the spring 42. When the spring 42 is compressed, the pin 41 which contacts with the spring 42 and abuts against the indentation 320 of the second teethed gear 32 is lifted by the compressed spring 42, such that the pin 41 is guided along the inclined inner wall 2201 and disengages from the indentation 320 of the second teethed gear 32. When the pin 41 is disengaged from the indentation 320 of the second teethed gear 32, the resilient unit 33 pushes the second teethed gear 32 to engage with the first teethed gear 31, such that the second teethed gear 32 is reinstated to mesh with the first teethed gear 31 (FIG. 3). The torque socket assembly is thereby reinstated to the preset stable torque value. When the user releases the outer sleeve 43, an elastic force of the spring 42 pushes the outer sleeve 43 to abut against the securing flange 13 of the base 1, allowing the user to instantly access the driver again.

Figure 5:
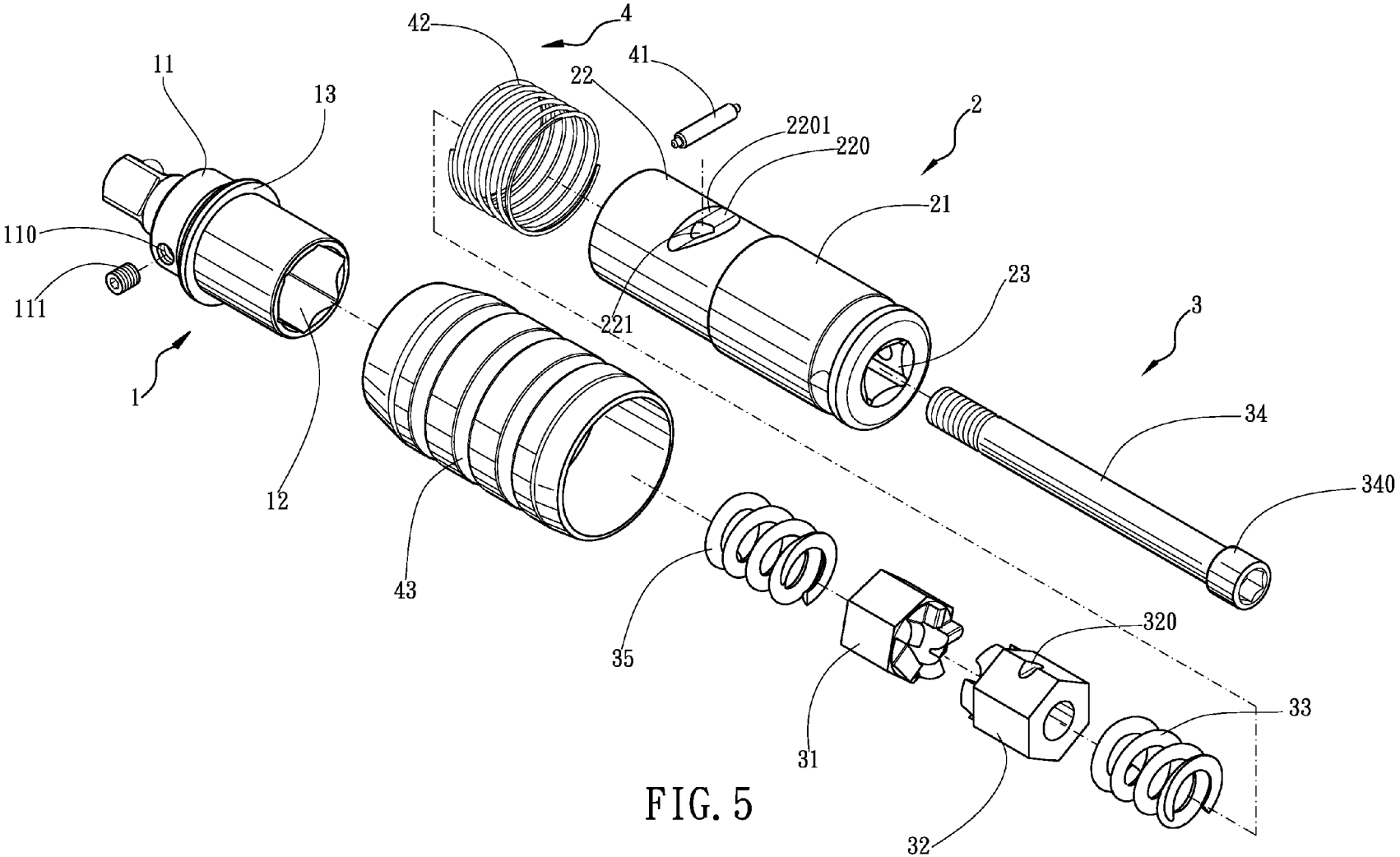
FIG. 5 is an exploded perspective view to show a second embodiment of the torque socket assembly in accordance with the present invention.
Figure 6:
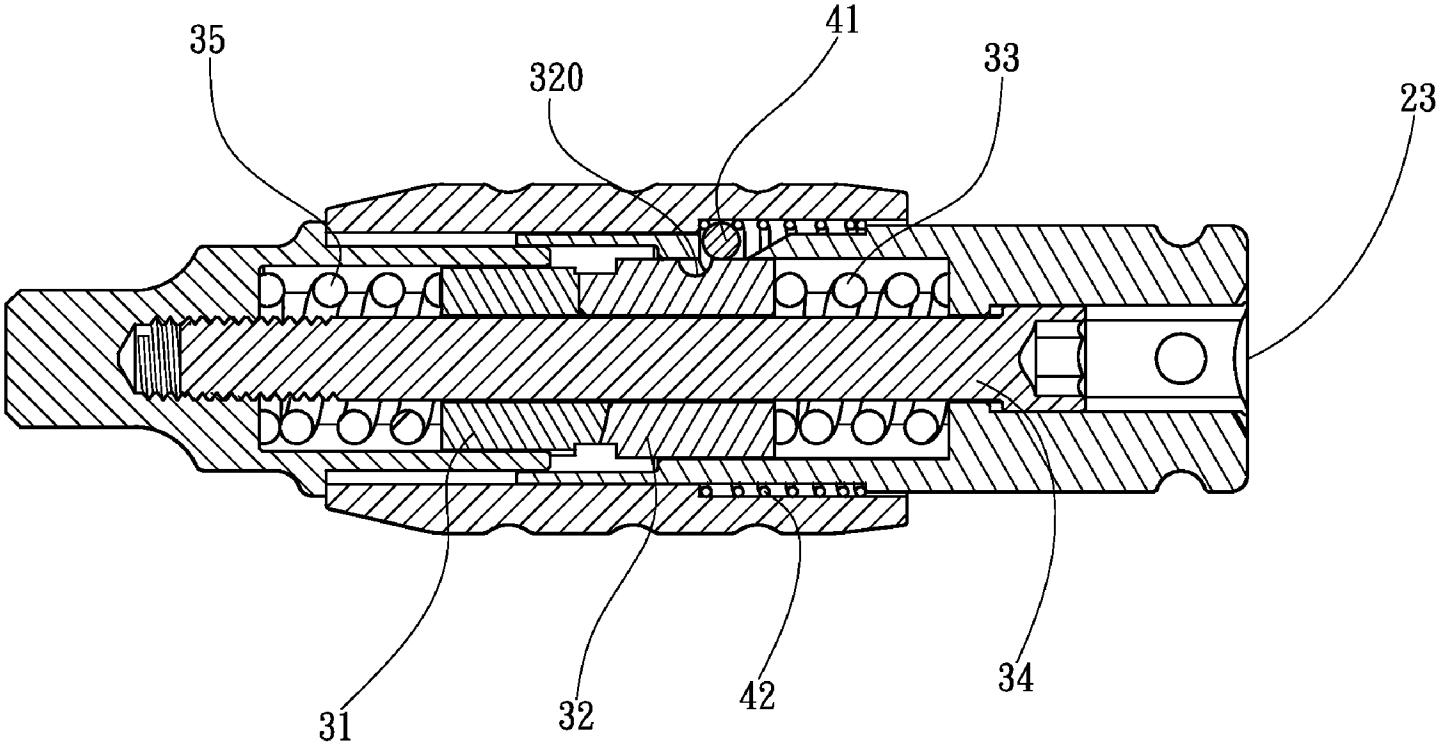
FIG. 6 is a cross sectional view to show the first and second teethed gear of the torque socket of the second embodiment of the torque socket assembly in accordance with the present invention meshed with each other.
Figure 7:
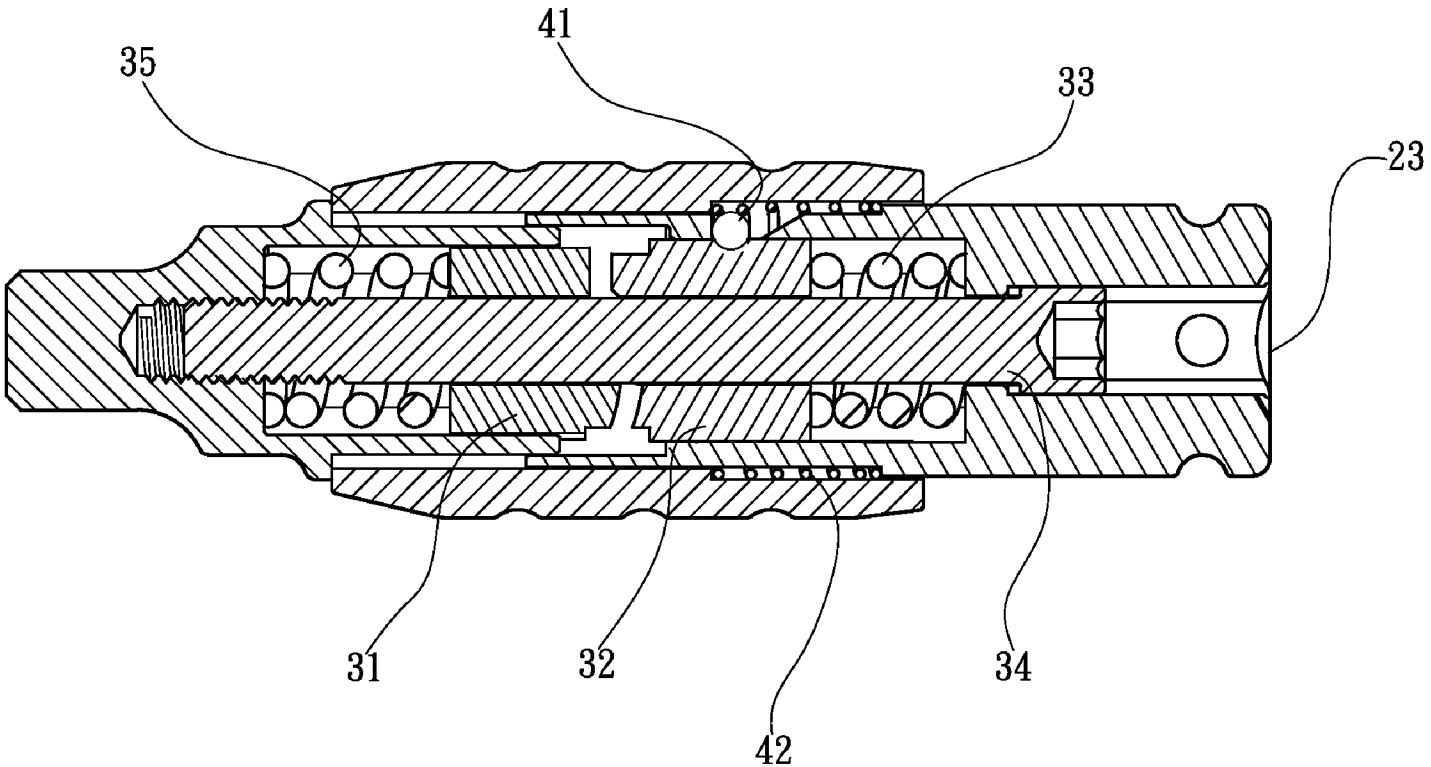
FIG. 7 is a cross sectional view to show the pin disposed in the recess of the first portion of the tube of the second embodiment of the torque socket assembly in accordance with the present invention falls into the indentation of the second teethed gear when the second teethed gear is disengaged from the first teethed gear.

With reference to FIG. 5 to FIG. 7, that shows a second embodiment of the torque socket assembly in accordance with the present invention. The elements and effects of the second embodiment which are the same with the first embodiment are not described, only the differences are described. In this embodiment, an elastic unit 35 is disposed in the receiving hole 12. The elastic unit 35 is abutted against a bottom of the receiving hole 12 and the first teethed gear 31. The elastic unit 35 co-operates with the resilient unit 33, such that the first and the second teethed gear 31 32 are evenly applied by the resilient unit 33 and the elastic unit 35. In addition, a co-operation of the resilient unit 33 and the elastic unit 35 provides a wider range of the torque value that can be preset.

Although the invention has been explained in relation to its preferred embodiment, it is to be understood that many other possible modifications and variations can be made without departing from the spirit and scope of the invention as hereinafter claimed.

What is claimed is:

1. A torque socket assembly comprising:

a base having a connecting portion formed on one end thereof adapted to connect with a driving tool, another end of the base having a receiving hole defined therein;

a tube sleeving on the base, the tube having a first portion and a second portion connected with the first portion, the first portion having a recess defined in an outer periphery thereof, the recess having a through hole defined in a bottom thereof; the second portion having a driving hole defined in one end thereof, the first portion partially sleeving on an outer periphery of the base such that the receiving hole communicated with the driving hole of the second portion;

a torque setting unit including a first teethed gear disposed in the receiving hole, a second teethed gear meshed with the first teethed gear, a resilient unit abutted against the second teethed gear and a bottom of the second portion, and a rod axially passing through the resilient unit, the first teethed gear and the second teethed gear; the second teethed gear having an indentation formed on an outer surface thereof; one end of the rod threadedly secured in the base, another end of the rod having a driving portion formed thereon adapted to receive a driver; and a securing unit including a pin disposed in the recess in the first portion, a spring sleeving on an outer periphery of the first portion of the tube and contacted with the pin, and an outer sleeve slidably sleeving on outer peripheries of the spring and the tube;

wherein by securing the rod within the base, the resilient unit is compressed, such that the resilient unit, the first and the second teethed gear provided a stable torque value; when an applying force has exceeded the stable torque value provided, the second teethed gear is abutted against the first teethed gear and slidably disengaged from the first teethed gear, such that the indentation of the second teethed gear is corresponded to the through hole of the recess, and the pin disposed in the recess falls in the indentation and is abutted against the indentation of the second teethed gear via the through hole for refraining the second teethed gear from engaging with first teethed gear.

2. The torque socket assembly as claimed in claim 1, further comprising an elastic unit disposed in the receiving hole of the base and abutting against a bottom of the receiving hole and the first teethed gear.

3. The torque socket assembly as claimed in claim 1, wherein the outer sleeve having an inner shoulder annularly formed on an inner periphery of one end thereof for abutting against the spring.

4. The torque socket assembly as claimed in claim 1, wherein the recess has two inclined inner walls oppositely formed on two sides thereof.

5. The torque socket assembly as claimed in claim 1, wherein the base has a securing hole laterally defined therein, a fastener screwing into the securing hole and abutted against the rod for confining the rod from rotating relative to the base.

6. The torque socket assembly as claimed in claim 1, wherein the first teethed gear and the second teethed gear are polygon-shaped.

7. The torque socket assembly as claimed in claim 1, wherein the base has a securing flange annularly formed on an outer periphery thereof for abutting against the outer sleeve to prevent the outer sleeve from overly sleeving on the base.

* * * * *